US008562097B2

(12) United States Patent
Muhl

(10) Patent No.: US 8,562,097 B2
(45) Date of Patent: Oct. 22, 2013

(54) TRANSPORT APPARATUS FOR FLAT MATERIALS TO BE PRINTED WITH ALIGNED SUPPORT BAR SYSTEM

(75) Inventor: Wolfgang Muhl, Hohen Neuendorf (DE)

(73) Assignee: Francotyp-Postalia GmbH, Birkenwerder (DE)

( * ) Notice: Subject to any disclaimer, the term of this patent is extended or adjusted under 35 U.S.C. 154(b) by 799 days.

(21) Appl. No.: 12/201,100

(22) Filed: Aug. 29, 2008

(65) Prior Publication Data

US 2009/0153609 A1 Jun. 18, 2009

(30) Foreign Application Priority Data

Dec. 17, 2007 (DE) ..... 10 2007 060 788

(51) Int. Cl.
*B41J 29/38* (2006.01)

(52) U.S. Cl.
USPC ..... 347/16

(58) Field of Classification Search
USPC ..... 347/16
See application file for complete search history.

(56) References Cited

U.S. PATENT DOCUMENTS

| | | | | |
|---|---|---|---|---|
| 2,266,524 | A * | 12/1941 | Welter | 101/20 |
| 2,421,150 | A * | 5/1947 | Jacobson | 355/117 |
| 3,951,257 | A | 4/1976 | Storace et al. | |
| 4,746,234 | A | 5/1988 | Harry | |
| 4,903,954 | A | 2/1990 | Robertson et al. | |
| 5,117,244 | A * | 5/1992 | Yu | 347/29 |
| 5,467,709 | A | 11/1995 | Salomon | |
| 5,467,973 | A | 11/1995 | Graushar et al. | |
| 5,813,326 | A | 9/1998 | Salomon | |
| 5,880,747 | A | 3/1999 | Bartenwerfer et al. | |
| 5,949,444 | A | 9/1999 | Geserich et al. | |
| 6,039,430 | A * | 3/2000 | Helterline et al. | 347/19 |
| 6,050,054 | A * | 4/2000 | Van Lierde et al. | 53/284.3 |
| 6,431,778 | B1 * | 8/2002 | Coudray et al. | 400/635 |
| 6,467,901 | B2 | 10/2002 | Von Inten | |
| 6,550,908 | B1 * | 4/2003 | Heitz et al. | 347/104 |
| 6,550,994 | B2 * | 4/2003 | Manduley | 400/611 |
| 6,585,433 | B2 | 7/2003 | Davies et al. | |
| 6,776,089 | B2 | 8/2004 | Kanda | |
| 2002/0127040 | A1 * | 9/2002 | Davies et al. | 400/76 |
| 2007/0196143 | A1 * | 8/2007 | Kaiho | 399/302 |

FOREIGN PATENT DOCUMENTS

| | | |
|---|---|---|
| CH | 597652 | 4/1978 |
| DE | 233 101 B5 | 10/1995 |
| DE | 196 05 014 C1 | 3/1997 |

(Continued)

*Primary Examiner* — Mark Robinson
*Assistant Examiner* — Andrew Jordan
(74) *Attorney, Agent, or Firm* — Laurence A. Greenberg; Werner H. Stemer; Ralph E. Locher

(57) ABSTRACT

A transport apparatus for flat materials to be printed includes a transport belt guided over a plurality of rollers along a centrally indented oval curve and supported on a supporting plate disposed above a supporting region of a roller carrier between a shaped partial plate and a bearing plate. A supporting surface area of the supporting plate is greater than a surface area of a printing window, and the transport belt has a width in the y-direction of a Cartesian coordinate system being wider than a width of the printing window. The indented section of the oval curve is configured at least partially for receiving a printing module or the bottom of at least one ink cartridge having a print head.

8 Claims, 3 Drawing Sheets

(56) References Cited

FOREIGN PATENT DOCUMENTS

| | | | |
|---|---|---|---|
| DE | 196 05 015 | C1 | 3/1997 |
| DE | 10032856 | A1 | 1/2002 |
| EP | 1 079 975 | B1 | 3/2001 |
| EP | 1 170 141 | B1 | 1/2002 |
| FR | 2742693 | A1 | 6/1997 |
| WO | 99/44174 | A1 | 9/1999 |

* cited by examiner

TRANSPORT APPARATUS FOR FLAT MATERIALS TO BE PRINTED WITH ALIGNED SUPPORT BAR SYSTEM

CROSS-REFERENCE TO RELATED APPLICATION

This application claims the priority, under 35 U.S.C. §119, of German Patent Application DE 10 2007 060 788.3, filed Dec. 17, 2007; the prior application is herewith incorporated by reference in its entirety.

BACKGROUND OF THE INVENTION

Field of the Invention

The invention relates to a transport apparatus for flat materials to be printed in a microprocessor-controlled printing unit, including a printing window for at least one print head of a printing module disposed above the printing window in the z-direction of a Cartesian coordinate system. The at least one print head thereof produces a printed image during printing in a direction opposite to the z-direction in the direction of the force of gravity. The printing window is disposed at the edge of a transport belt in a housing part. The transport belt transports the flat materials to be printed at an edge past the at least one print head in the transport direction x during printing. The flat materials are pressed onto the transport belt in a supporting region counter to the force of gravity. The invention is used in microprocessor-controlled printing apparatuses and is suitable for franking machines and other mail processing units. The invention permits a low offset of dots to be achieved during printing which improves, in particular, a machine readability of an imprint of a franked item of mail.

An apparatus which employs a transport principle and has a belt that lies at the top and a sprung back pressure apparatus that lies underneath, between which an item of mail is clamped, is known from East German Patent Application DD 233 101 B5, corresponding to U.S. Pat. No. 4,746,234. However, a thermal transfer ink ribbon which is used is unsuitable as a transport belt. The thermal transfer ink ribbon is disposed above a feed table, over which the items of mail are transported in a lying manner downstream in the direction of the mail flow. The feed table has openings, through which a driven back pressure roller engages on the item of mail.

U.S. Pat. No. 6,550,994 has disclosed a franking machine having a transport apparatus for items of mail, by way of which transport apparatus the letters are transported through the franking machine through the use of a transport belt which lies at the top and a plurality of sprung levers which are disposed underneath. Similar subject matter is also apparent from U.S. Pat. Nos. 5,813,326, 6,776,089 and U.S. Pat. No. 6,585,433. The transport belt is mounted in the manner of a loop on rollers and does not allow the printing module or a part thereof to protrude into the region between the rollers. The width of the transport belt is relatively small and corresponds to approximately 1 inch. The extent of the housing transversely with respect to the transport direction of the items of mail is relatively great in comparison. An additional factor is that a second printing position is provided for printing franking strips which are rolled up on reels and which are unrolled for printing. That second printing path causes higher production costs.

U.S. Pat. No. 5,467,709 has already disclosed a printing apparatus for an inkjet franking machine, in which a franking imprint is printed onto an item of mail through the use of an inkjet print head during approximately horizontal letter transport. The inkjet print head is disposed in a stationary manner behind a guide plate in a recess for printing. A circulating transport belt, which is likewise disposed on the side of the guide plate, serves as a transport apparatus. A supporting and pressing apparatus having a plurality of rollers is disposed on the other side opposite the guide plate, with the result that an item of mail which is fed in is clamped between the rollers of the supporting and pressing apparatus and the circulating transport belt. However, the apparatus cannot avoid oblique running of the printing media. An insufficiently tensioned transport belt or a not exactly parallel alignment of the axles of those rollers, on which the transport belt circulates, is sufficient to involve the above-mentioned risk. The supporting and pressing apparatus is very complicated as a result of the multiplicity of rollers of that apparatus.

German Patent DE 196 05 015 C1, corresponding to U.S. Pat. No. 5,949,444, has already proposed an embodiment of a printing apparatus of an inkjet franking machine which is the JetMail® apparatus of the applicant of the instant application, Francotyp-Postalia AG & Co. That embodiment carries out a franking imprint during non-horizontal, approximately vertical letter transport through the use of an inkjet print head which is disposed in a stationary manner behind a guide plate in a recess. A circulating transport belt having pressing elements for the items of mail (letters up to 20 mm thickness, DIN (German Standard) B4 format) or for franking strips, which are configured in such a way that they can be adhesively bonded to packages of any desired thickness, serves as a transport apparatus. The printing medium (letter, package, franking strip) is clamped between the pressing elements and the guide plate.

Transport and drive apparatuses of relatively simple construction without a back pressure apparatus (see German Patent DE 196 05 014 C1) or with a back pressure apparatus (see International Publication No. WO 99/44174) in the vicinity of the printing region using at least one inkjet print head, have also already been proposed. In International Publication No. WO 99/44174, the latter is disposed downstream of an intake roller pair in the transport direction of the mail flow, with the upper roller being driven and the lower back pressure roller being sprung. A further roller pair downstream of the inkjet print head in the mail flow direction close to an ejection device likewise exerts a force on the printing medium. The printing region is spaced apart from the force transmission region of one of the roller pairs by more than one radius of the respectively driven roller. Although the printing information can in principle be changed in all regions by digital printing, the print quality becomes lower as a higher transport speed is selected. In particular, during the use of two inkjet print heads, an offset in the printed image (butting or connection error) can occur along a printed length in the transport direction. The offset makes evaluation of the printed image by machine difficult. The action of the force of the further roller pair downstream of the inkjet print head in the direction of the mail flow close to the ejection device leads to different distances being covered and therefore to the butting or connection error in the printed image in the case of two inkjet print heads which are offset with respect to one another. The print quality which is required in the context of current programs of mail deliverers (for example, the Information Based Indicia Program of the USPS) would therefore only be possible to achieve at a low printing speed. The low thickness of the printing media which can be printed by a printing apparatus that is constructed simply in that way is also disadvantageous.

European Patent EP 1 079 975 B1, corresponding to U.S. Pat. No. 6,431,778, has disclosed an apparatus for printing characters on a predefined location of one side of a flat recording medium, and has also disclosed a franking machine which is equipped correspondingly. A transport belt is disposed firstly on the inkjet print head side and secondly forms an unsuspended supporting device for that side of a flat recording medium (object, item of mail, envelope) which is to be printed. A back pressure apparatus supports the flat object from below. In that back pressure apparatus, a belt rolls around at least two other rollers, at least one of which is not suspended.

An apparatus which is known from European Patent EP 1 170 141 B1, corresponding to U.S. Pat. No. 6,467,901, for printing a printing medium in the printing region, uses a driven transport drum and nondriven back pressure rollers in the force transmission region or, as an alternative, a nondriven back pressure conveyor belt. In the printing region, a stationary inkjet print head prints the printing medium which is moved downstream, with the inkjet print head being disposed axially with respect to the transport drum. The printing region is preferably approximately 1 inch and is spaced apart from the force transmission region, with the spacing of the most remote pixel from the edge of the transport drum being smaller than the radius of the circumference of the transport drum. However, the slight approximately linear contact of that surface of the item of mail which is to be printed with the transport drum and an intake wheel for items of mail which is disposed at a spacing are disadvantageous. The intake wheel is driven by the transport drum through a toothed belt. This causes a $\Delta x$ offset of the dots in the printed image. A $\Delta y$ offset of the dots in the printed image results orthogonally with respect thereto, in particular in the case of items of mail having a very large format. Moreover, the construction causes high production costs.

In the market segment of franking machines having small to medium mail item throughputs, a compact transport apparatus for items of mail is required, with production costs which are as low as possible.

SUMMARY OF THE INVENTION

It is accordingly an object of the invention to provide a transport apparatus in a printing apparatus for flat materials, which overcomes the hereinafore-mentioned disadvantages of the heretofore-known devices of this general type and which ensures high print quality at a medium throughput of flat materials during interaction with a printing apparatus controlled by a microprocessor. Despite low production costs, the reliability of the printing apparatus is to be as high as possible and printing offset in the x-direction and y-direction is to be low. In this case, firstly postcards and secondly C4 sized letters having a mail item thickness of up to 10 mm are to be processed.

With the foregoing and other objects in view there is provided, in accordance with the invention, in a microprocessor-controlled printing unit including a printing window and a printing module disposed above the printing window in a z-direction of a Cartesian coordinate system, the printing module having at least one print head associated with the printing window for producing a printed image during printing in a direction opposite to the z-direction in the direction of the force of gravity, a transport apparatus for flat materials to be printed by the printing unit. The transport apparatus comprises a supporting region extended on both sides of a line running centrally through the printing window transversely relative to a transport direction x in a y-direction of the Cartesian coordinate system. A transport belt is provided, onto which the flat materials are pressed in the supporting region counter to the force of gravity. The transport belt is disposed in a housing part and has an edge at which the printing window is disposed. The transport belt transports the flat materials to be printed at the edge past the at least one print head in the transport direction x during printing, and the transport belt has a width, in the y-direction of the Cartesian coordinate system, being wider than a width of the printing window. A roller carrier has a supporting region, a shaped partial plate, a bearing plate, a supporting plate and a plurality of rollers for guiding the transport belt along a centrally indented oval curve. A tensioning roller tensions the transport belt tautly in the indented section and configures the indented section at least partially for receiving the printing module or a bottom or bulge of at least one ink cartridge having the print head. A supporting plate supports the transport belt and is disposed above the supporting region of the roller carrier between the shaped partial plate and the bearing plate. The supporting plate has a supporting surface area greater than a surface area of the printing window.

Thus, a printing module is disposed above a printing window in the z-direction of a Cartesian coordinate system counter to the direction of gravity. During printing, a printed image is produced by at least one print head. For example, at least one print head of an ink cartridge ejects ink droplets through the printing window in the direction of the force of gravity, counter to the z-direction. The printing window is disposed at the edge of a transport belt in a housing part. The transport belt transports a flat material which is to be printed at the edge past the at least one print head in the transport direction x during printing. The flat materials are pressed onto the transport belt in a supporting region, counter to the force of gravity.

It has been shown empirically that a supporting region advantageously stretches over both sides of a line which extends centrally through the printing window transversely with respect to the transport direction x in the y-direction of the Cartesian coordinate system. The transport belt is supported on a supporting plate which is disposed above the transport region between a shaped partial plate and a bearing plate of a roller carrier. The supporting surface area of the supporting plate is greater than the surface area of the printing window which is adjacent the supporting plate.

The roller carrier includes the shaped partial plate, the bearing plate, the supporting plate and a number of rollers for guiding the transport belt along a centrally indented oval curve. The transport belt is tensioned tautly in the indented section through the use of a tensioning roller. In order to compensate for the action of the tensioning force, a pull rod is disposed on the bearing plate on the outside. The indented section is configured at least partially for receiving a printing module or the bottom of at least one ink cartridge having a print head and is shaped correspondingly. In the y-direction of the Cartesian coordinate system, the transport belt has a width which is wider than the width of the printing window.

The mail item transport apparatus has a flat belt acting as the transport belt, through the use of which guidance is improved during transport of the items of mail. The printing offset in the x-direction and y-direction is less than 100 μm in both directions.

As a result of the bottom of the ink cartridge protruding into the space which is produced by the indentation and as a result of a second printing path for franking strips being dispensed with, the print head is disposed relatively close to the transport belt edge when the printing module has been moved into the printing position. The printing module can be moved in a manner which is known per se from the printing position into a cleaning and sealing position, by a transverse moving device, transversely with respect to the mail item transport direction. The cleaning and sealing position can advantageously be disposed closer to the transport belt. As a result, the extent of the chassis and the housing transversely with respect to the mail item transport direction is likewise reduced.

Other features which are considered as characteristic for the invention are set forth in the appended claims.

Although the invention is illustrated and described herein as embodied in a transport apparatus for flat materials to be printed, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
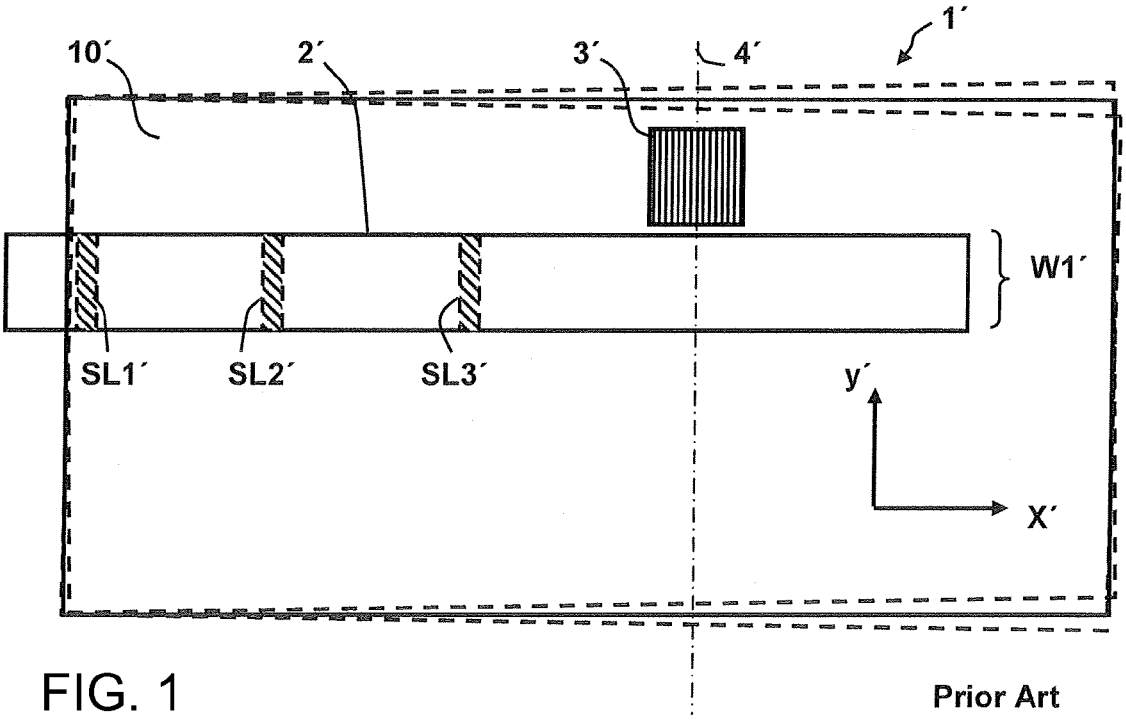
FIG. 1 Prior Art
FIG. 1 is a diagrammatic plan view of a basic illustration of a known transport apparatus of a first type.

Referring now to the figures of the drawings in detail and first, particularly, to FIG. 1 thereof, there is seen a plan view of a basic illustration of a known transport apparatus 1' of a first type. An item of mail 10' is pressed onto a transport belt 2' from below by a number of supporting bars SL1', SL2' and SL3', which cannot be seen from above and are therefore illustrated by using dashed lines, and is transported in a transport direction x' during printing. A width W1' of the transport belt 2' in a y'-direction orthogonally with respect to the transport direction x' lies in the order of magnitude of a printing window 3' for at least one print head. At the beginning, the item of mail 10' is pressed onto the transport belt 2' from below by the three supporting bars SL1', SL2' and SL3'. The printing window 3' is disposed in a known manner in a non-illustrated housing part and is spaced apart from a supporting region. The supporting region is to be understood as that region, in which the item of mail is pressed onto the mail item transport apparatus 1'. During the mail item transport, the number of active supporting bars is reduced to the same extent as the item of mail is transported away out of the supporting region. The guidance which is impaired as a result leads to an offset of the item of mail. The offset item of mail has been shown by using dashed lines and the offset has been illustrated in an exaggerated manner for the purpose of improved clarity. As an alternative, the supporting bars are configured as sprung or resilient supporting wheels or rolls which can be pressed on. The center of the printing window 3' is indicated by a line 4' which extends orthogonally with respect to the transport direction x', that is to say in the y'-direction, and is spaced apart from the supporting region in the x'-direction.

Figure 2:
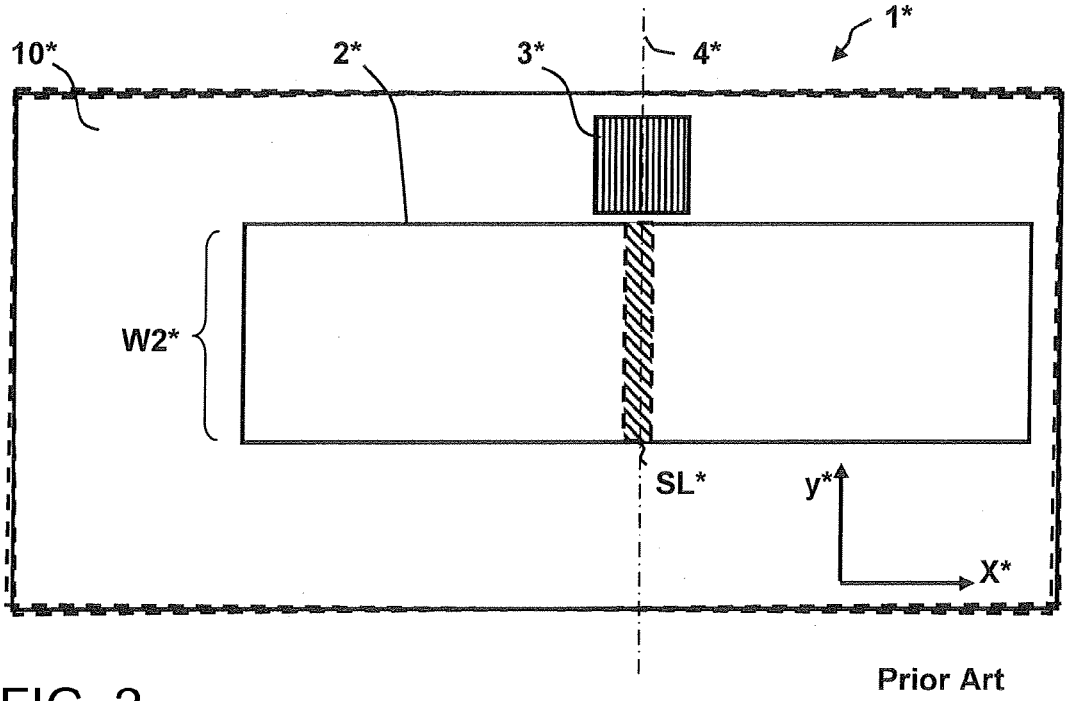
FIG. 2 Prior Art
FIG. 2 is a plan view of a basic illustration of a known transport apparatus of a second type.

FIG. 2 shows a plan view of a basic illustration of a known transport apparatus 1* of a second type. An item of mail 10* is pressed onto a transport drum 2* from below by only one supporting bar SL*, which cannot be seen from above and is therefore illustrated by using dashed lines, and is transported in a transport direction x* during printing. A width W2* of the transport drum 2* in the transverse direction, that is to say in a y*-direction, is greater than that of a printing window 3* for at least one print head. As an alternative, the supporting bars are configured as sprung or resilient supporting wheels or rolls which can be pressed on. According to an apparatus which is known from European Patent EP 1 170 141 B1, corresponding to U.S. Pat. No. 6,467,901, for printing a printing medium in the printing region, a driven transport drum and nondriven back pressure rollers or, as an alternative, a nondriven back pressure conveyor belt, are used in a force transmission region. The back pressure apparatus includes a sprung or resilient swinging arm having a conveyor belt, in order to increase the supporting region. The center of the printing window 3* is indicated by a line 4* which also extends through the center of the supporting region. Its extent is orthogonal with respect to the transport direction x*, that is to say in the y*-direction, because the printing window 3* is spaced apart from the supporting region or back pressure region only in the y*-direction but not in the x*-direction. The latter measure is sufficient to reduce the offset of printed image points (dots) in the x-direction and y-direction. The offset is at most 110 μm.

Figure 3:
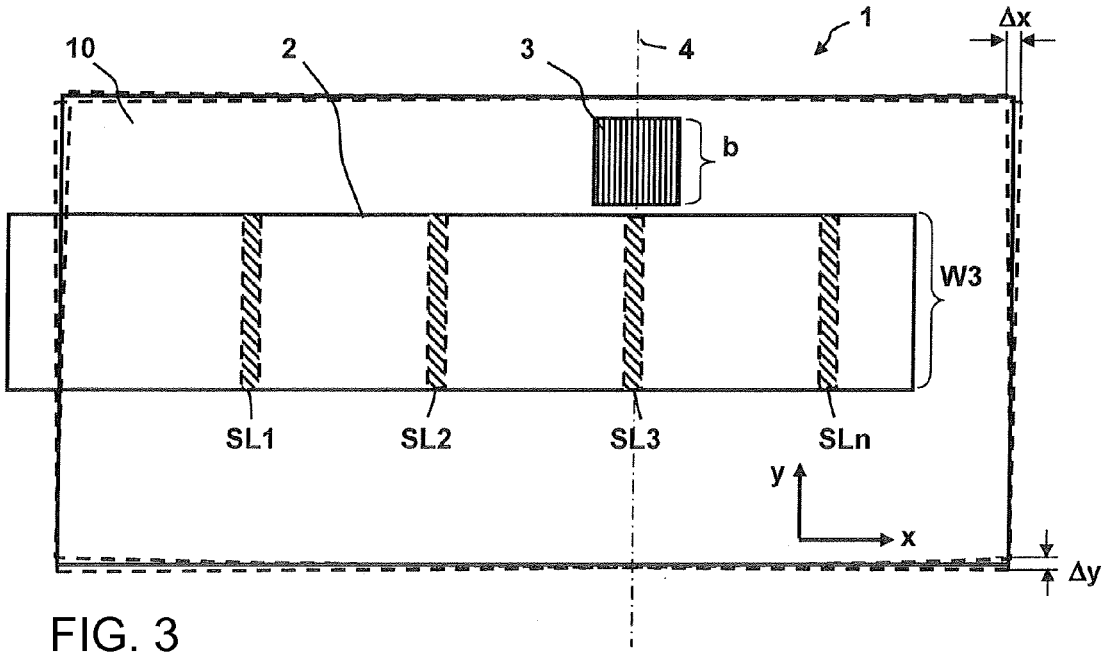
FIG. 3 is a plan view of a basic illustration of a transport apparatus of a proposed type according to the invention.

FIG. 3 shows a plan view of a basic illustration of a transport apparatus 1 of the proposed type. The center of the printing window 3 is again indicated by a line 4 which also extends through the center of a supporting bar SL3. A transport belt 2 of the transport apparatus 1 and the printing window 3 are adjacent one another most closely in this case. An offset Δx, Δy is reduced by a further 10 to 30% if the item of mail 10 is transported in a transport direction x during printing, if further supporting bars SL1, SL2 and SLn are pressed onto an item of mail 10 from below on both sides of the illustrated line 4, and if the transport belt 2 bears against a supporting plate at the top.

Figure 4:
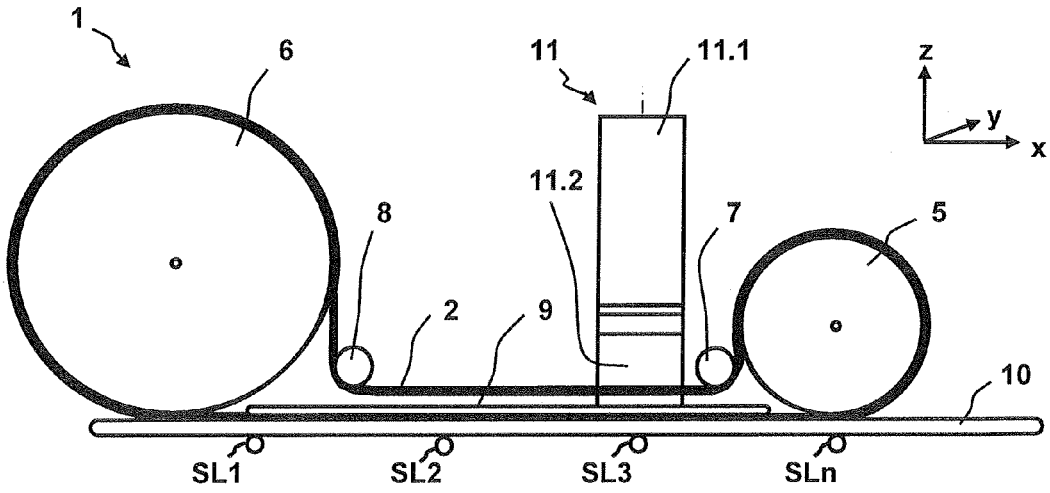
FIG. 4 is a front-sectional view of a basic illustration of the transport apparatus of the proposed type according to the invention.

FIG. 4 shows a section through a front view of a basic illustration of a transport apparatus 1 of the proposed type. The transport belt 2 of the transport apparatus is guided back in a loop over a driven roller 5 of medium size and a large encoder and deflection roller 6. The loop of the transport belt 2 is indented in a central region by two further small deflection rollers 7, 8. In this case, the transport belt 2 runs above and below a supporting plate 9 which supports the transport belt 2 in a section that runs back to the driven roller 5 of medium size. In other words, a pulling run of the transport belt is transported in the transport direction by the smooth supporting plate 9 at least from the center of the mail item transport apparatus. At the same time, the small deflection roller 8 serves as a tensioning roller for tensioning the transport belt 2. The nondriven large roller 6 is a constituent part or component of a non-illustrated encoder. An item of mail 10 is pressed onto the transport belt 2 from below by a number of supporting bars SL1, SL2, SL3 and SL4 and is transported in the transport direction x during printing. At least one ink cartridge 11 is used in a printing unit which is controlled by a microprocessor and has a printing window, through which at least one inkjet print head 11.2 of the at least one ink cartridge 11 sprays ink droplets onto a surface to be printed of the item of mail 10 or flat material. In a Cartesian coordinate system, the x-direction is the transport direction of the item of mail 10 or flat material which is transported in such a way that it lies on the side which is not to be printed. The y-direction points to the rear towards the rear side and the z-direction points to the top towards the upper side of the printing unit which is controlled by a microprocessor.

The Cartesian coordinate system has a transport direction x, a direction z which is orthogonal with respect thereto counter to the force of gravity, and a direction y which is orthogonal with respect thereto and with respect to the transport direction x. The non-illustrated printing window is disposed in the y-direction transversely with respect to the supporting plate 9. The at least one ink cartridge 11 has an expansion or bulge 11.1 which is directed toward the front and the inkjet print head 11.2 which is directed downward. The ink cartridge 11 is disposed in the Cartesian coordinate system in such a way that, in the printing position, the expansion or bulge 11.1 of the ink cartridge 11 is directed to the front, that is to say counter to the transverse direction y, and upward, that is to say counter to the force of gravity in the direction z which is orthogonal with respect to the transport direction x.

Figure 5:
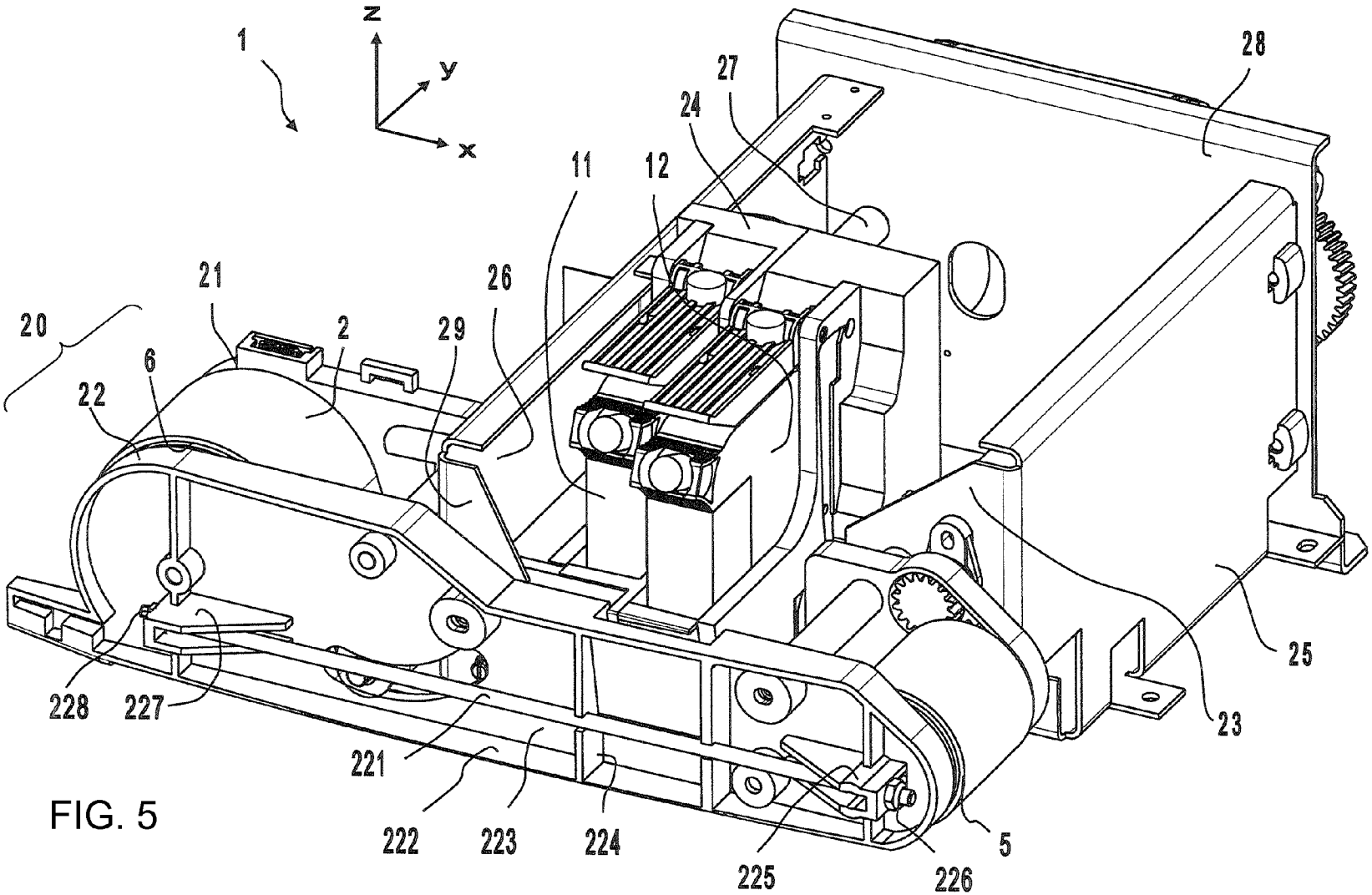
FIG. 5 is a perspective view of the proposed transport apparatus according to the invention having a printing module in a printing position.

FIG. 5 shows a perspective view of a transport apparatus 1 having a printing module in a printing position. The transport apparatus is a substantial constituent part or component of a franking machine and is disposed above a non-illustrated feed table for items of mail.

The printing module includes a printing carriage 24, a contact and actuating unit for the ink cartridges, and the ink cartridges themselves which are equipped in each case with an inkjet print head. For example, two ½" ink cartridges 11 and 12 from Hewlett Packard are used and are disposed offset in the x/y-direction with respect to one another. The printing carriage 24 is disposed on two transverse bars 27 in such a way that it can be moved transversely, and can be moved into a box-shaped space in the y-direction transversely with respect to the mail item transport direction (x-direction). The box-shaped space is formed by a metal chassis. The metal chassis includes a right-hand side wall 25 which merges into a bracket 23 that is angled away by 90° toward the front side. The metal chassis includes a left-hand side wall 26 which merges into a bracket 29 that is angled away by 90° toward the front side. The right-hand side wall 25 and the left-hand side wall 26 are fastened to a rear wall 28. A bearing plate 22 is fastened through the transverse bars or rods 27 to the rear wall 28, for example by screws. The bearing plate 22 has a number of rollers, on which the flat belt 2 is tensioned. The flat belt 2 of the mail item transport apparatus 1 has a high transverse rigidity and is guided over two outer deflection rollers 5 and 6 which are concealed partially by the bearing plate 22 and are disposed in each case at the ends of the bearing plate and the shaped partial plate. In this case, the flat belt 2 runs through firstly under the downwardly pointing supporting surface of the non-illustrated supporting plate and is secondly guided back between the bottom of the ink cartridges 11, 12 and the upwardly pointing surface of the supporting plate. In the printing position, the printing module protrudes partially into the intermediate space between the deflection rollers, with the inkjet print heads of the two ink cartridges being situated in the non-illustrated printing window which is disposed outside the transport region. The left-hand side wall 26 has a greater length in the y-direction than the right-hand side wall 25, with the angled away bracket 29 of the left-hand side wall 26 pointing in the x-direction (transport direction) and the angled away bracket 23 of the right-hand side wall 25 pointing counter to the x-direction. The angled away bracket 23 of the right-hand side wall 25 reaches to a shaped partial plate 21 and the bracket 29 of the left-hand side wall 26, which is angled away in the x-direction, reaches to the inner side of the bearing plate 22. The shaped partial plate 21 and the bearing plate 22 are spaced apart from one another in accordance with the width of the flat belt 2.

The bearing plate 22 has, on its front side, an inwardly smooth base plate 223 with edge strips 222 which are bent forward and frames 224 for the purpose of reinforcing and producing a sufficient torsional rigidity, as well as clamping devices 225, 226, 227 and 228 and a pull rod 221, in order to absorb tensile forces which act on the bearing plate 22 during tensioning of the flat belt 2 and in order to set or to compensate for torsion or deflection of the bearing plate in a defined manner. The shaped partial plate 21 likewise has an inwardly smooth base plate. In a manner which is not shown, a spacing between the shaped partial plate 21 and the bearing plate 22 is ensured firstly by the rollers and their bearing axles and secondly by the one supporting plate (concealed) which is disposed between the shaped partial plate 21 and the bearing plate 22. The shaped partial plate 21, the bearing plate 22, the supporting plate and the rollers 5, 6, 7 and 8 are assembled to form a roller carrier 20. The driven transport belt forms an oval loop which is indented from the top, with the indentation being shaped by the additional deflection rollers 7, 8 in front of and behind the ink cartridges. The transport belt is guided along under the bottom of the ink cartridges in both directions, with the pulling run of the transport belt being supported in the transport direction from the center of the transport apparatus by a smooth surface which lies in the opposite direction to the z-direction, that is to say points downward.

Sufficient space is produced by the indentation and the bottom of the ink cartridge can likewise point forward. The front wall of the mail item transport apparatus is configured as a one-sided bearing plate for the deflection rollers and has a metallic pull rod, through the use of which the opposing tensile force to the belt tensile force of the flat belt is applied. The pull rod is disposed parallel to the x-direction, that is to say to the mail item transport direction. In this configuration, the ink cartridges can be removed directly upward, without beforehand having to assume a position which is provided for that purpose.

The transport apparatus having a printing module is used in a printing unit which is controlled by a microprocessor, for example in a franking machine, for transporting items of mail. In a manner which is not shown and as is known, a franking machine includes, inter alia, an electronic part (meter) and the mail item transport apparatus with an electronic controller and a pressing apparatus. The non-illustrated pressing apparatus, which presses against the item of mail from below in a sprung or resilient manner, is disposed below a feed table which is known per se. A keyboard and a display unit of the meter are connected to the electronic part in a known manner which is not shown. As is known, the electronic controller is connected firstly to an encoder and secondly to a motor of the mail item transport apparatus in order to actuate it.

The invention is not restricted to the present embodiment. Rather, a number of devices are conceivable within the scope of the claims. Those devices are used and are included by the present claims in a manner which proceeds from the same basic concept of the invention.

The invention claimed is:

1. In a microprocessor-controlled printing unit including a printing window and a printing module disposed above the printing window in a z-direction of a Cartesian coordinate system, the printing module having at least one print head associated with the printing window for producing a printed image during printing in a direction opposite to the z-direction in the direction of the force of gravity, a transport apparatus for flat materials to be printed by the printing unit, the transport apparatus comprising:

a supporting region extended on both sides of a line running centrally through the printing window transversely relative to a transport direction x in a y-direction of the Cartesian coordinate system, said supporting region having a plurality of supporting bars including one supporting bar aligned with a center of the printing window and at least one supporting bar disposed on each side of the center of the printing window;

a transport belt onto which the flat materials are pressed in said supporting region counter to the force of gravity by said plurality of supporting bars being pressed directly against the flat materials, said transport belt disposed in a housing part and having an edge at which the printing window is disposed, said transport belt transporting the flat materials to be printed at said edge past the at least one print head in said transport direction x during printing, and said transport belt having a width, in the y-direction of the Cartesian coordinate system, being wider than a width of the printing window;

a roller carrier disposed in said supporting region, said roller carrier having a shaped partial plate, a bearing plate, a supporting plate and a plurality of rollers for guiding said transport belt along a centrally indented oval curve;

a tensioning roller tensioning said transport belt tautly in said indented section and configuring said indented section at least partially for receiving the printing module or a bottom of at least one ink cartridge having the print head; and said supporting plate supporting said transport belt and being disposed above said supporting region of said roller carrier between said shaped partial plate and said bearing plate, said supporting plate having a supporting surface area greater than a surface area of the printing window.

2. The transport apparatus according to claim 1, wherein said transport belt is a flat belt.

3. The transport apparatus according to claim 2, wherein:

said supporting plate has a downwardly pointing supporting surface and an upwardly pointing surface;

said plurality of rollers includes two outer deflection rollers each disposed at a respective end of said bearing plate and said shaped partial plate;

said flat belt has a high transverse rigidity and is guided over said two outer deflection rollers; and said flat belt firstly runs under said downwardly pointing supporting surface of said supporting plate and secondly is guided back between a part of the printing module and said upwardly pointing surface of said supporting plate.

4. The transport apparatus according to claim 1, wherein:

said printing module includes a printing carriage, a contact and actuating unit for two ink cartridges and the ink cartridges each being equipped with an inkjet print head;

a box-shaped space is formed by a metal chassis having a right-hand side wall merging frontward into a bracket angled away by 90° and reaching said shaped partial plate and a left-hand side wall merging frontward into a bracket angled away in the x-direction by 90° and reaching an inner side of said bearing plate, causing the printing module to protrude partially into an intermediate space between said deflection rollers in a printing position and the inkjet print heads of the two ink cartridges are situated in the printing window disposed outside a transport region; and a transverse bar carries the printing carriage for movement transversely and into said box-shaped space in the y-direction transversely relative to the mail item transport direction.

5. The transport apparatus according to claim 2, wherein the at least one ink cartridge is used in the microprocessor-controlled printing unit and has the printing window, through which the at least one inkjet print head of the at least one ink cartridge sprays ink droplets onto a surface to be printed of an item of mail or flat material being transported by said flat belt and lying on a side not to be printed.

6. The transport apparatus according to claim 1, wherein:

in the Cartesian coordinate system, the x-direction is the transport direction of the item of mail or flat material being transported while lying on a side not to be printed, the y-direction points to the rear toward a rear side and the z-direction points upward toward an upper side of the microprocessor-controlled printing unit;

the printing window is disposed in the y-direction transversely relative to said supporting plate; and the at least one ink cartridge has a bulge directed forward and an inkjet print head directed downward.

7. The transport apparatus according to claim 1, wherein the microprocessor-controlled printing unit is a franking machine.

8. In a microprocessor-controlled printing unit including a printing window and a printing module disposed above the printing window in a z-direction of a Cartesian coordinate system, the printing module having at least one print head associated with the printing window for producing a printed image during printing in a direction opposite to the z-direction in the direction of the force of gravity, a transport apparatus for flat materials to be printed by the printing unit, the transport apparatus comprising:

a supporting region extended on both sides of a line running centrally through the printing window transversely relative to a transport direction x in a y-direction of the Cartesian coordinate system, said supporting region having a plurality of supporting bars including one supporting bar aligned with a center of the printing window and at least one supporting bar disposed on an upstream side of the center of the printing window and a plurality of said supporting bars disposed on a downstream side of the center of the printing window;

a transport belt onto which the flat materials are pressed in said supporting region counter to the force of gravity by said plurality of supporting bars being pressed directly against the flat materials, said transport belt disposed in a housing part and having an edge at which the printing window is disposed, said transport belt transporting the flat materials to be printed at said edge past the at least one print head in said transport direction x during printing, and said transport belt having a width, in the y-direction of the Cartesian coordinate system, being wider than a width of the printing window;

a roller carrier disposed in said supporting region, said roller carrier having a shaped partial plate, a bearing plate, a supporting plate and a plurality of rollers for guiding said transport belt along a centrally indented oval curve;

a tensioning roller tensioning said transport belt tautly in said indented section and configuring said indented section at least partially for receiving the printing module or a bottom of at least one ink cartridge having the print head; and said supporting plate supporting said transport belt and being disposed above said supporting region of said roller carrier between said shaped partial plate and said bearing plate, said supporting plate having a supporting surface area greater than a surface area of the printing window.

* * * * *